United States Patent [19]

Benson

[11] Patent Number: 4,741,300

[45] Date of Patent: May 3, 1988

[54] ROTATING CYLINDER INTERNAL COMBUSTION ENGINE

[76] Inventor: Donald W. Benson, 1907 S.E. 19th St., Pompano Beach, Fla. 33062

[21] Appl. No.: 58,163

[22] Filed: Jun. 4, 1987

[51] Int. Cl.[4] ..... F02B 57/00

[52] U.S. Cl. ..... 123/43 R; 123/44 D

[58] Field of Search ..... 123/43 R, 44 D; 91/197, 91/491; 417/269

[56] References Cited

U.S. PATENT DOCUMENTS

| | | | |
|---|---|---|---|
| 984,358 | 2/1911 | Dawson | 123/43 R |
| 2,990,820 | 7/1961 | Saijo | 123/44 D X |
| 3,292,603 | 12/1966 | Wayto | 123/44 D X |
| 3,499,424 | 3/1970 | Rich | 123/44 D |
| 4,077,365 | 3/1978 | Schlueter | 123/44 D X |
| 4,166,438 | 9/1979 | Gottschalk | 123/44 D X |
| 4,307,695 | 12/1981 | Vasilantone | 123/44 D X |

FOREIGN PATENT DOCUMENTS

| | | | |
|---|---|---|---|
| 3002144 | 7/1981 | Fed. Rep. of Germany | 123/43 R |
| 1190753 | 4/1959 | France | 123/44 D |

*Primary Examiner*—Michael Koczo

*Attorney, Agent, or Firm*—Robert M. Schwartz; Edward I. Mates

[57] ABSTRACT

A valve-free engine of 4n (4, 8, 12, etc.) cylinders comprises a fixed inner assembly comprising a pair of sun gears, a fixed outer assembly comprising fore and aft elements and a rotatable intermediate assembly. Each outer assembly element has an intake port and an exhaust port spaced circumferentially and offset from intake port and exhaust port of the outer element. Eight (or 4n) pairs of planetary gears rotate about the sun gears to control the in and out movement of pistons within a plurality of cylinder heads in a controlled pattern so that the distance of each diametrically opposite piston from the fixed inner assembly changes constantly and equally. The cylinder heads support piston cylinders along axes that are oblique to radii from said fixed shaft at a constant angle to said radii that is constructed and arranged to propel its piston in the direction of rotation of the intermediate assembly. Each cylinder head has an intake opening and an exhaust opening located alternately to that of the adjacent cylinder heads so that the intake and exhaust for odd number cylinder heads take place from one pair of outer assembly elements only and the intake and exhaust for even numbered cylinder heads take place from the other pair of outer assembly elements. This structure enables alternate firing of odd number and even number cylinder heads.

11 Claims, 7 Drawing Sheets

ROTATING CYLINDER INTERNAL COMBUSTION ENGINE

FIELD OF THE INVENTION

This invention relates to valve free rotary engines. Particularly, this invention relates to such eight cylinder engines that are specifically developed for outdoor outboard motor type vehicles such as boats.

DISCUSSION OF PRIOR ART

Rotary valve free engines of the prior art have been characterized by pistons moving relative to their center of gravity in such a manner as to cause vibration of the engine relative to its mounting. Also, piston cylinders of prior art engines are oriented at less than optimum orientation to rotate a drive shaft.

As will be seen in greater detail subsequently, three major assemblies including a rotatable intermediate assembly between two fixed assemblies, are required for the engine of the present invention. U.S. Pat. No. 4,077,365 to Schlueter, 2,475,813 to Broyles and 3,499,424 to Rich, show engines having two major assemblies. Such construction makes it impossible to operate in the manner of alternately intaking and exhausting from opposite sides of two fixed assemblies, an inner assembly and an outer assembly, between which a rotatable intermediate assembly rotates.

U.S. Pat. No. 1,014,596 to Hatcock shows a five cylinder engine with piston rods connected to a central point rather than to a planetary gear. Any engine having a number of cylinders not divisible by four to result in an integer cannot operate in the manner of this invention.

U.S. Pat. No. 4,530,316 to Morrison incorporates valves. This invention is intended for use without valves.

U.S. Pat. No. 2,408,800 to Myer has five cylinders and connecting rods connected to a central gearing system different from the one of the present invention.

U.S. Pat. No. 2,433,933 to Stucke discloses a three cylinder engine that does have valves. Also the axis of the cylinder in this reference is oriented along the radius, whereas the present invention requires its piston cylinders to be oblique to a radial line.

U.S. Pat. No. 2,242,231 to Cantoni shows connecting rods connected to one central gear but the weight distribution is such that a weight unbalance occurs when all the pistons are in the down position for both lower cylinders and some of the upper cylinders.

Additional patents such as U.S. Pat. No. 4,010,719 to Lappa, 4,166,438 to Gottschalk, 1,042,675 to Helmes, 4,421,073 to Arregui and 4,038,949 to Farris all show only two major assemblies making it impossible for the device to operate in the manner of the present invention.

GENERAL DESCRIPTION OF PRESENT INVENTION

The main benefit of the present invention is to provide an engine that is relatively free of vibration during use and that uses the explosions that rotate a rotatable intermediate assembly efficiently. The first benefit is obtained by insuring that the moving parts of the presently claimed invention are simultaneously in balanced relation relative to the center of gravity of the motor throughout each cycle of rotation. The first benefit is obtained by enclosing the moving parts of the engine of the present invention between a fixed inner assembly and a fixed outer housing to provide a rotatable intermediate housing that moves in a circular path between the inner and outer fixed housings and yet is provided with a series of inwardly and outwardly moving elements that move obliquely to in a generally radial inner and outer direction and pass various intake and exhaust openings in a unique program during each cycle of rotation. The second benefit is obtained by orienting piston cylinders in such a manner that the pistons move inward obliquely to radii radiating from said center of gravity in a direction of rotation tangent to sun gears when combustion takes place.

The engine of the present invention is free of valves. This lack of valve structure avoids the tendency of valve containing engines to have the moving valve parts interfere with free flow of gases into and out of the various valve cylinders.

Another feature of the present invention provides the ability to obtain an explosion every 45 degrees turn of a circularly moving part, whereas in a conventional eight cylinder engine, the explosions occur after 90 degrees of rotation which requires twice the speed of rotation in order to obtain a given RPM rating.

Another feature of this invention is a unique piston arrangement in which pistons are caused to move with a component of motion in the direction of rotation of the rotating moving element of the motor every time there is a combustion.

Another feature of this invention involves the use of a cover assembly that is fixed to both an inner and outer fixed assembly and provided with auxiliary bearings between the cover assembly and a rotatable intermediate assembly that helps resist wobble of the rotatable intermediate assembly as it rotates between the inner and outer fixed assemblies.

A further feature of this invention is the provision of bearing means within the cover assembly to prevent axial movement of the intermediate assembly relative to the cover assembly.

The present invention also incorporates a grooved auger, a hub attaching the auger to the rotatable intermediate portion, a path for lubricant through the hub and the auger between said intermediate and the inner fixed portion to provide a path for lubricant into the bearings and then by centrifugal force into each of eight cylinder housings to help lubricate the latter and then for exhaust into a lubricant recovery system.

Still another feature of this invention is the use of piston cylinders that are removably mounted within the rotatable intermediate portion.

The preferred embodiment of the present invention incorporates a fixed outer assembly which comprises a fore element and an aft element bolted together. A cylinder head is fixed to the outer end of each piston cylinder and said cylinder heads are connected to one another to form a circumferential belt surrounding the intermediate assembly. This feature enables the exhaust gases of one cylinder to be contained within the respective cylinder and to be exhausted through the ports provided by said one cylinder head only and not go into other cylinder heads as the intermediate assembly continues to rotate.

The present invention is further characterized by a spark plug operatively associated with each piston cylinder.

Each cylinder head of this invention comprises an exhaust opening constructed and arranged for moving alignment with alternate exhaust ports to provide alternate alignment with two opposite outer assembly elements of the fixed outer assembly as the intermediate rotational assembly rotates within said fixed outer assembly.

A preferred embodiment of the present invention operates 8 pairs of planetary gears mounted on a sun gear pair. A crank is supported between each planetary gear pair in eccentric relation thereto. Cranks of adjacent planetary gear pairs are mounted on radial planes offset by 45 degrees from one another. The gear ratio of the sun gears to planetary gears is 2 to 1. The orientation of the crank ends to the planetary gears is such that pistons associated with the cranks move inward and outward in conjunction with the sweeping of intake and exhaust openings in piston cylinder heads past intake and exhaust ports in the fixed outer assembly in correlated time relation.

The reason why a valve-free eight cylinder engine comprising a fixed inner assembly, a fixed outer assembly and a rotatable intermediate assembly movable in a circular path between the fixed inner assembly and the fixed outer assembly to minimize vibration is important will be discussed in greater detail as a preferred embodiment of the present invention is described.

It is noted that the present invention will be described in terms of an eight cylinder engine. However, it is understood that the principles of the present invention may be used with engines whose number of cylinders is divisible by four.

BRIEF DESCRIPTION OF DRAWINGS

In the drawings that form part of a description of a preferred embodiment of this invention.

DETAILED DESCRIPTION OF PREFERRED EMBODIMENT

Figure 1:
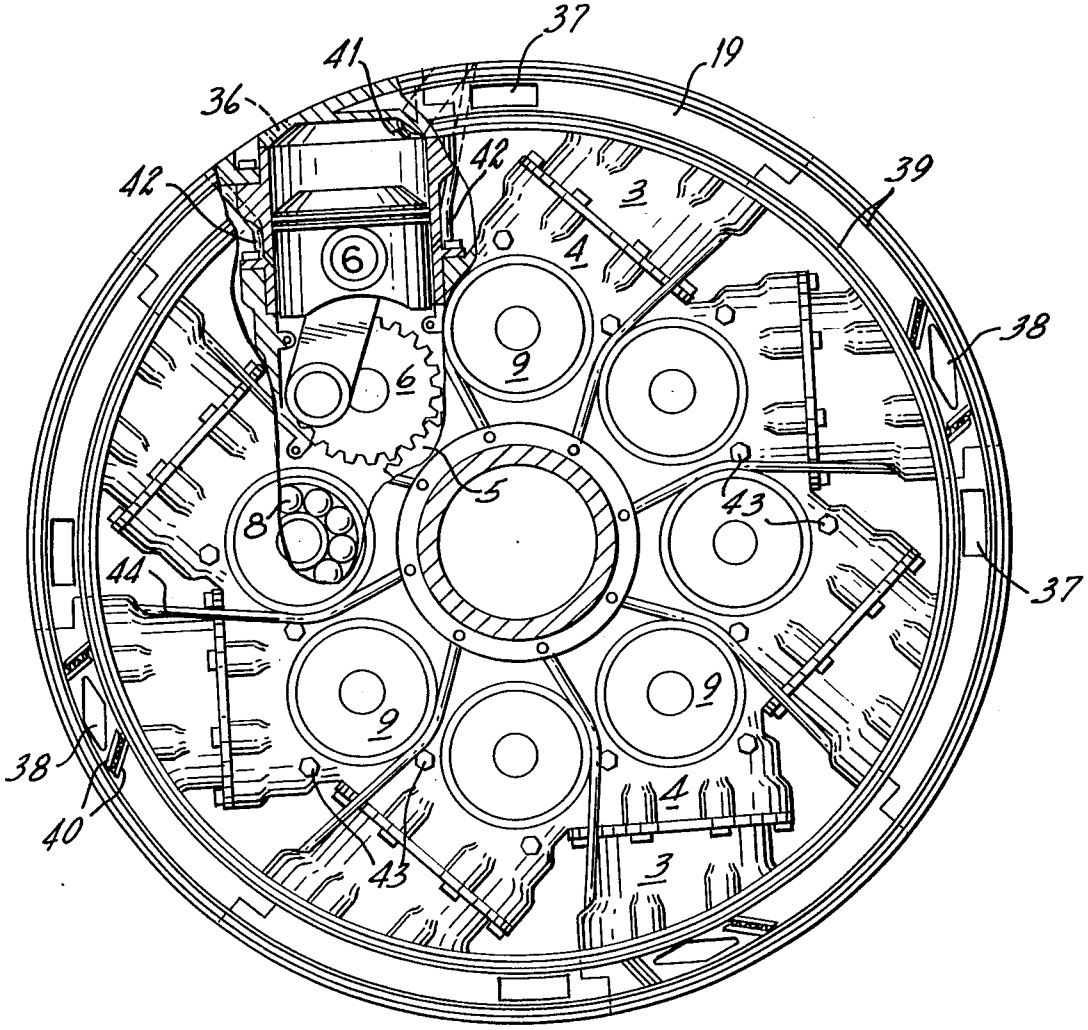
FIG. 1 is an elevational view with parts shown in section of a rotatable intermediate assembly of an engine conforming to this invention with its fixed inner assembly and its fixed outer assembly omitted for clarity.

Referring to the drawings, the apparatus of the present invention comprises an inner assembly which includes an inner shaft 1 (FIG. 2) splined to a pair of sun gears 5. The inner shaft 1 and the pair of sun gears 5 splined thereto comprises the main portion of the fixed inner assembly. An outer housing 2 (see FIG. 2) surrounds an intermediate assembly whose housing 4 is depicted surrounding a cylinder wall 3.

The fixed inner assembly comprises the inner assembly shaft 1, extending axially inward from its position of splining to a cover assembly 51 of an outer assembly comprising outer housing 2, and the pair of sun gears 5 mounted in axially spaced relation along the length of the inner assembly shaft 1. Eight planetary gears 6 are mounted in meshed relation around each sun gear 5 in parallel relation so that each planetary gear faces a twin planetary gear in spaced relation thereto. Each of the eight twin pairs of planetary gears 6 includes a planetary gear interconnected to its twin planetary gear 6 through a crankshaft 7 that is mounted between the axially aligned planetary gears. Each crankshaft is eccentrically mounted with respect to the pair of planetary gears 6 that it interconnects.

The crankshafts 7 have identical constructions and the opposite ends of each crankshaft 7 are mounted to a pair of parallel planetary gears 6 in a common radial plane. The common radial planes for adjacent crankshaft ends 7 differ by 45 degrees between adjacent pairs of planetary gears 6. The gear ratio of sun gears to planetary gears is 2 to 1 so that each pair of planetary gears 6 rotates twice about its common axis of rotation for each rotation about the pair of sun gears 5.

Figure 3:
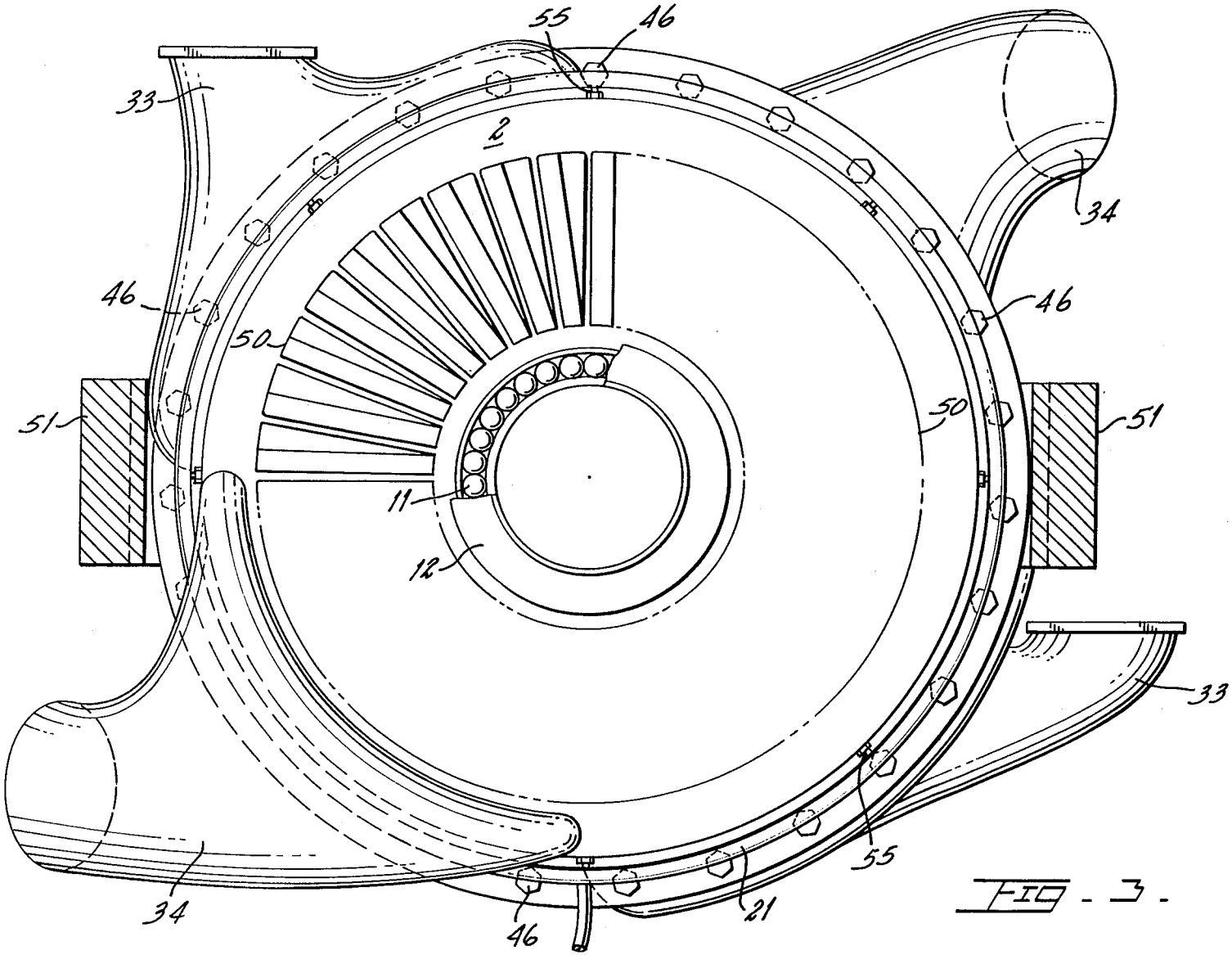
FIG. 3 is a sectional view taken along the line 3—3 of FIG. 4 and is at right angles to the view of FIG. 2 and is a view of the front of the engine of the present invention omitting a cover assembly shown in FIG. 4.

The outer assembly 2 is formed of two outer assembly elements called as a fore assembly element 2A and an aft assembly element 2B. Along the perimeter of the fore and aft assembly elements are alternate intake ports 33 and exhaust ports 34. (See FIG. 3.) One intake port 33 shown on the northwest corner of fore outer assembly element 2A is diametrically opposite the position occupied by an intake port 33 at the southeast corner of aft outer assembly element 2B. Also, the exhaust port 34 for outer fore assembly element 2A at its southwest corner is diametrically opposite the exhaust port 34 of aft outer assembly element 2B at its northeast corner. FIG. 3 also shows that intake port 33 for fore outer assembly element 2A extends counterclockwise approximately 90 degrees from the north to west, then the exhaust port 34 of the fore outer assembly element 2A extends from west to south, intake port 33 of aft outer assembly element 2B extends from south to east and exhaust port 34 of aft outer assembly element 2B extends from east to north.

The offset portion of each crankshaft 7 is connected to a piston 63. Each piston 63 is slidably mounted within a cylinder wall 3 unique for each piston. Thus, each piston will have two cycles of in and out movement for each revolution of its planetary gear pair around the sun gear pair.

Referring back to FIG. 2, the crankshafts are mounted in crankshaft bearings 8 which are within a cover seal 9. The crankshafts 7 are mounted eccentrically to the planetary gears 6 and are connected to pistons 63 by rigid links to have each crankshaft 7 cause movement of a piston 63 with which said crankshaft 7 is linked within cylinder 3. The latter serves as a piston housing. The cylinders for the pistons are arranged to extend slightly obliquely to spokes in a wagon wheel. The individual piston cylinders are located at 45 degree circumferential spacing with respect to each adjacent piston cylinder and are received within cylinder heads 19. The latter are connected to and enclose the cylinders 3. Adjacent cylinder heads 19 are interconnected by overlapping and interlocking said adjacent cylinder heads to form a circumferential belt that encloses the rotatable intermediate assembly casing 4. Cylinders 3 are mounted oblique to radii extending every 45 degrees from the inner assembly shaft for a reason to be explained later.

Figure 2:
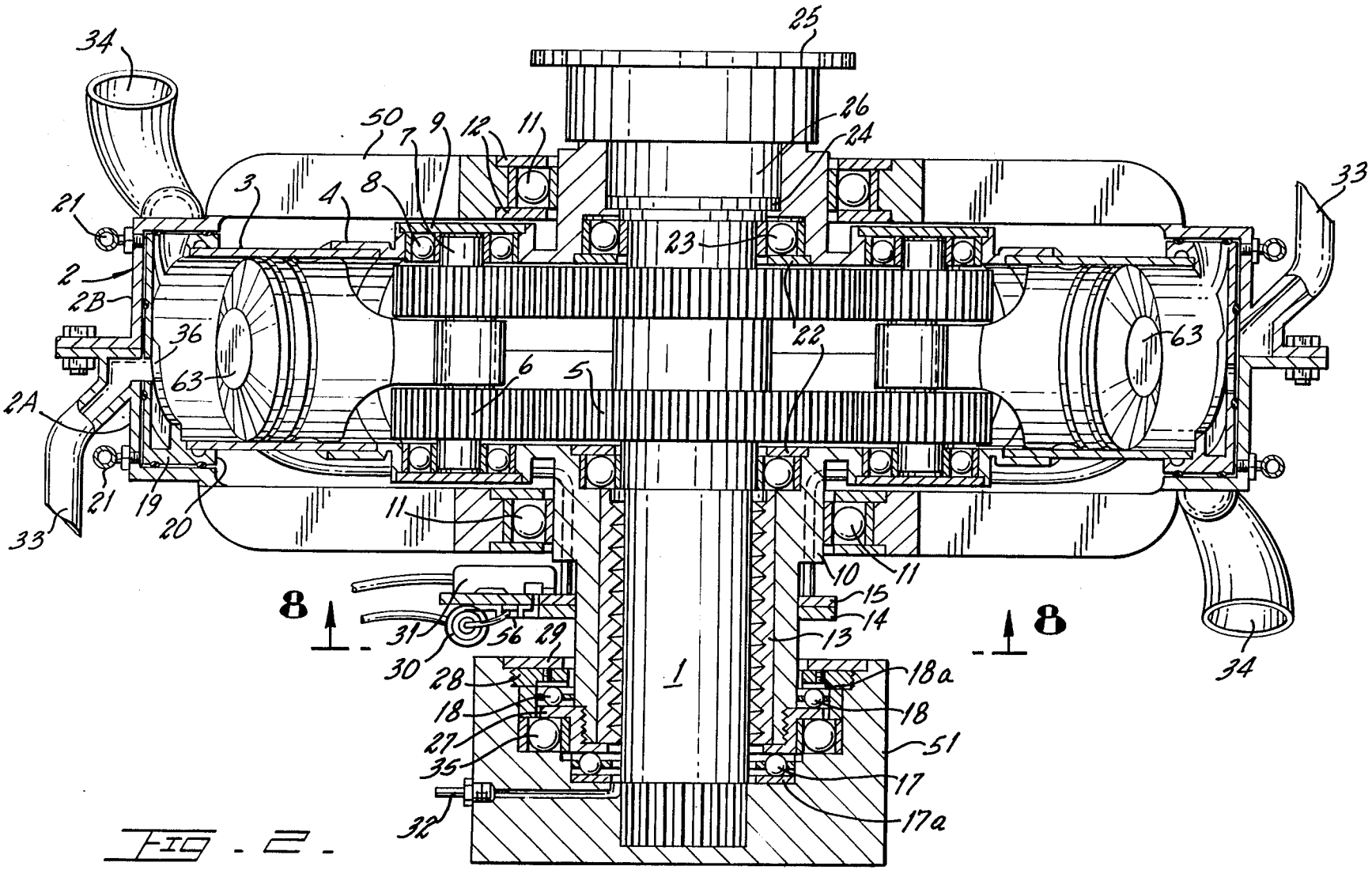
FIG. 2 is a sectional view taken along the line 2—2 of FIG. 4 that intersects the longitudinal axis of the engine of the preferred embodiment.

The intermediate assembly has a pipe 10. The pipe rotates relative to the inner assembly shaft 1 through main bearings 11 and 35. An auger 13 is mounted within the pipe 10 and is connected to a path for supplying lubricant from an oil entry port 32. The lubricant moves axially along said path from bottom to top as seen in FIG. 2 between the auger 13 and the inner assembly shaft 1 to the inner end of the path where lubricant is supplied radially outwardly to bearings 23 and also bearings 8 by centrifugal force. Also, lubricant is supplied to main bearing 11.

Figure 4:
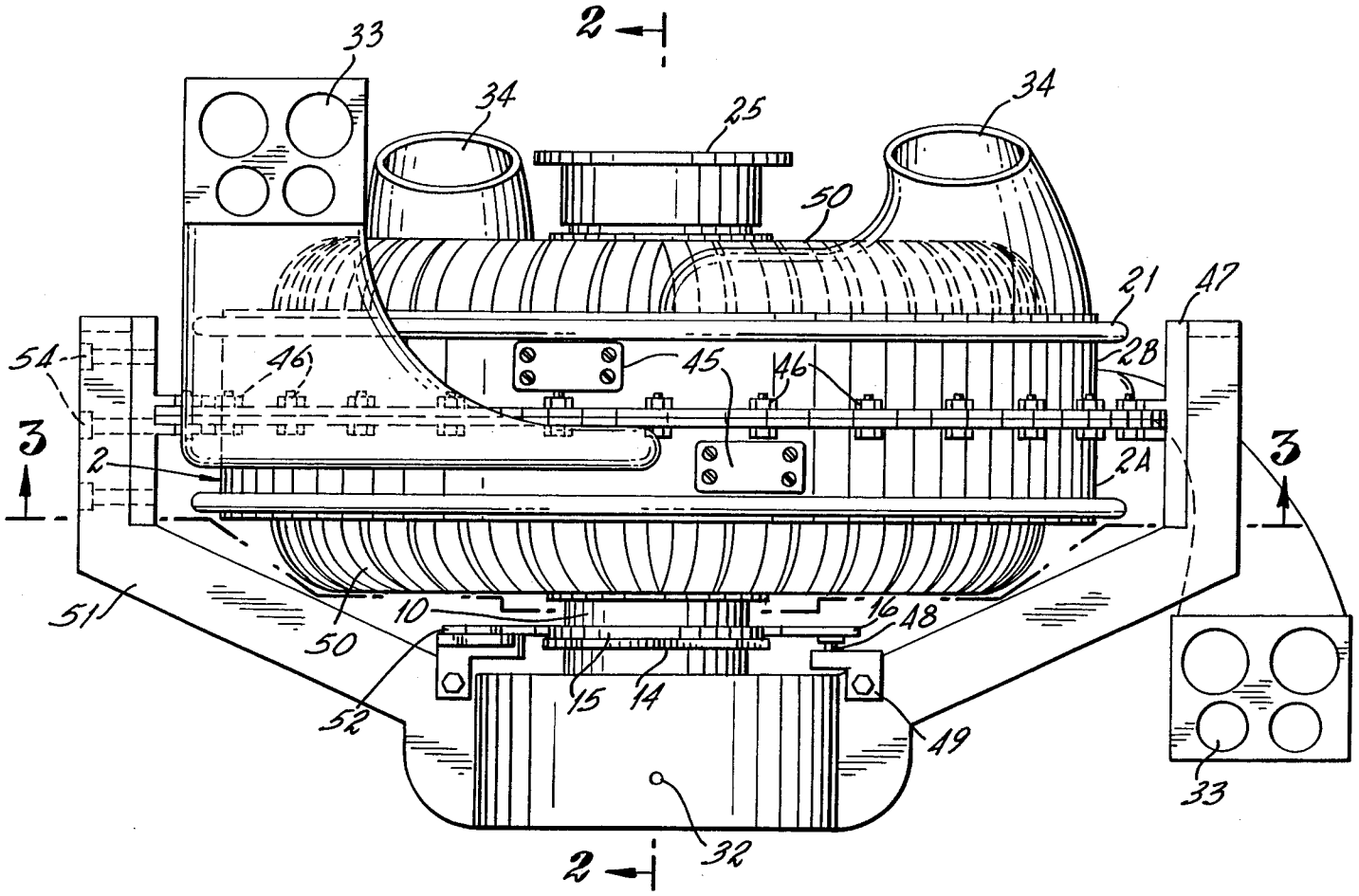
FIG. 4 is a plan view of the motor of the present invention including the cover assembly omitted from FIG. 3.
Figure 8:
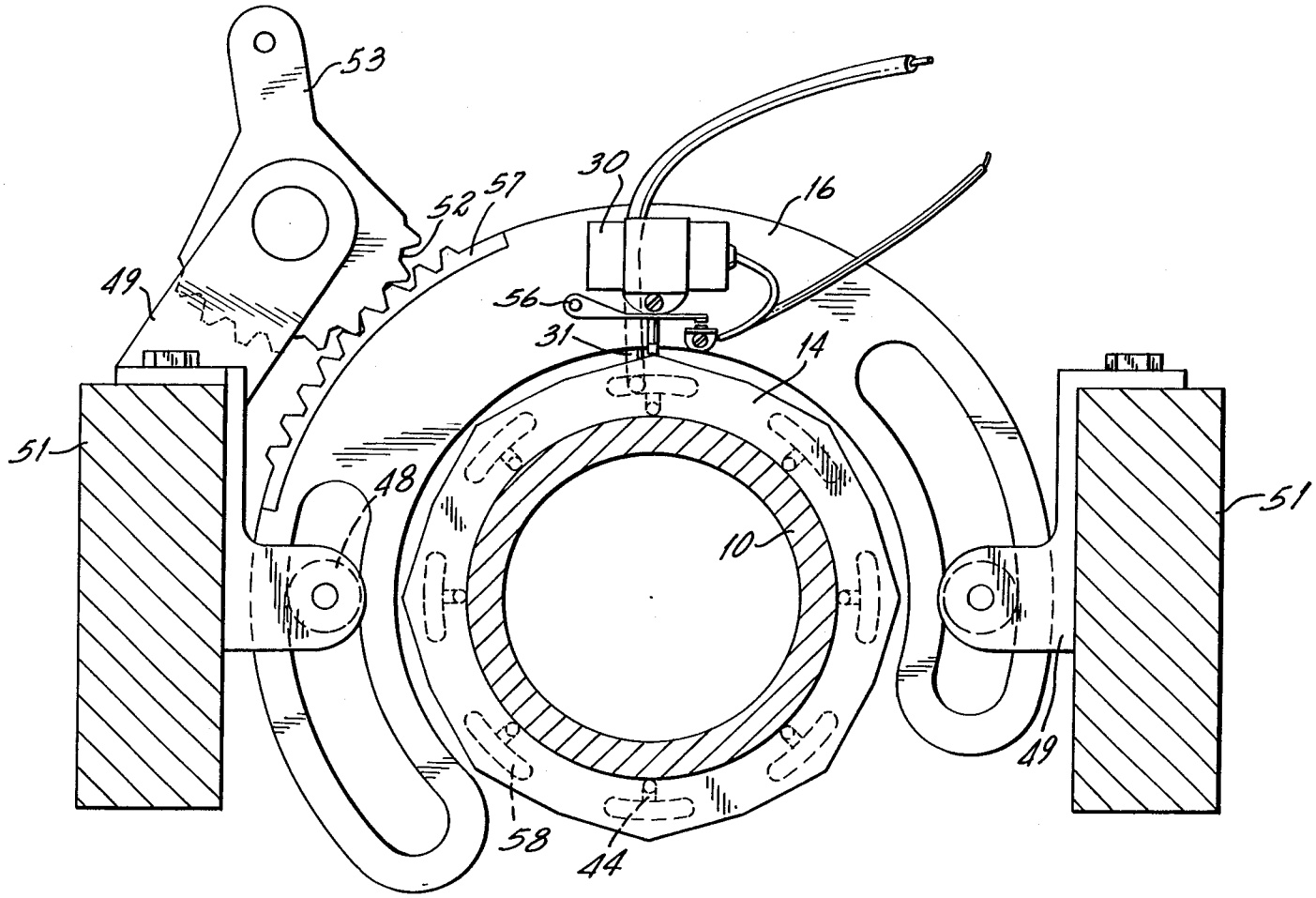
FIG. 8 is a schematic view of an electrical advance system incorporated in a preferred embodiment of this invention.

Also attached to the pipe 10 is an octagonal cam 14 and a strike plate 15. These form part of an ignition system which is standard conventional equipment for such apparatus. FIG. 4 shows a pair of diametrically opposed floating ignition plates 16 engagable by the strike plate 15. FIG. 2 shows a condenser 30 and coil brush 31 included in an ignition system to be described later. FIG. 8 shows details of one of the floating ignition plates.

Bearing means is provided to prevent axial displacement of the inner assembly shaft 1 relative to the assembly pipe 10 of the rotatable intermediate assembly 4. This bearing means incorporates a bearing 17 mounted within a bearing housing that contains an adjustable bearing pressure plate 17A to control movement of the bearing plate 17 toward the bottom. This construction limits movement of the intermediate assembly 4 toward the bottom as seen in FIG. 2 relative to the inner assembly 1. An additional bearing 18 mounted with an adjustable bearing pressure plate 18A controls movement of the intermediate assembly 4 toward the top relative to the inner fixed assembly 1.

If desired, the cylinder head 19 may be provided with a ring gear or teeth notch 20 to serve as a starter. This is conventional in engine equipment of this type. Each outer assembly element, that is the fore element 2A and the aft element 2B of the outer assembly 2, support a circumferential oil recovery tube 21.

Seals 22 are provided for the inner assembly main bearings 23 shown in FIG. 2. A cover seal 24 is also provided. A power take off member 25 is provided at the top of FIG. 2 for connection of the rotating intermediate assembly and a drive shaft to be rotated. This is conventional.

A bearing retainer hub 27 is provided to hold the auger 13 in place around the inner assembly shaft 1. An aft retainer ring 28 is also provided. The latter is screwed into cover assembly 51 of the outer assembly.

A main bearing 35 for the cover assembly 51 is located a considerable distance from the central plane in which the intermediate assembly 4 rotates. This bearing construction minimizes the amount of wobble that results from clearances within the main bearings 11 when the engine is in use.

Referring back to FIG. 1 and FIG. 2, each cylinder head 19 is provided with an intake opening 36 on the outer edge and ventilation openings 37 on one side edge in addition to exhaust openings 38 on its other side edge. Alternate cylinder heads 19 are numbered consecutively to have an odd numbered cylinder head alternating with an even numbered head around the circumference of rotatable assembly 4. If even number heads 19 have their intake openings 36 capable of communicating only with the intake port 33 on the fore outer assembly element 2A, and their ventilation openings 37 and exhaust openings 38 capable of communicating with the exhaust port 34 of aft outer assembly element 2B only, the odd numbered cylinder heads 19 intermediate the first alternate heads 19 are reversely oriented with respect to the position of their intake openings 36 and ventilation and exhaust openings 37 and 38 so that when intermediate assembly casing 4 rotates, the intake openings 36 of the odd number cylinder heads 19 communicate only with intake port 33 of aft outer assembly element 2B but not with intake port 33 of fore outer assembly element 2A and their ventilation openings 37 and exhaust openings 38 communicate with the exhaust port 34 of fore outer assembly element 2A but not with exhaust port 34 of aft element 2B while the intake openings 36 of the even number cylinder heads communicate only with intake port 33 only of fore outer assembly element 2A but not with intake port 33 of aft outer assembly element 2B and their ventilation openings 37 and exhaust openings 38 communicate with exhaust port 34 of aft element 2B but not exhaust port 34 of fore element 2A.

The outer edge of the cylinder heads 19 are provided with perimeter ventilation opening seals 39 around their ventilation openings 37 and exhaust opening seals 40 surrounding exhaust openings 38. The seals are preferably composed of synthetic rubber or plastic.

An oil exit hose 42 is provided. As the intermediate assembly rotates, oil is passed from the oil exit hose 42 into the space between the rotating intermediate assembly 4 and the outer assembly 2 and then radially outwardly by centrifugal force until it is captured by the oil recovery tube 21 and recirculated. FIG. 3 shows an oil exit opening 55 of outer assembly 2. This is part of the oil recovery system that feeds oil into oil recovery tube 21.

The fore assembly element 2A is bolted to the aft assembly element 2B by a series of outer assembly cover bolts 46 (FIG. 1). Bolts 43 extend through spaces intermediate the cylinders 3. Also, outer assembly cover bolts 46 (FIG. 3) mount together the perimeters of the stationery elements of the outer assembly 2A and 2B°

Figure 5:
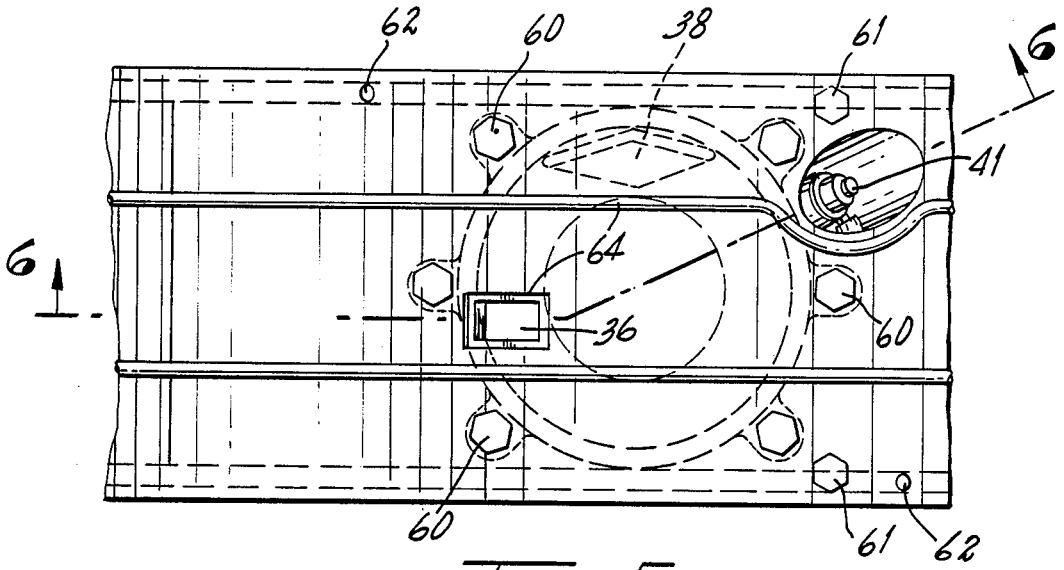
FIG. 5 is an enlarged detail view of a portion of the intermediate assembly, particularly a cylinder head showing its association with an inlet port, an exhaust port and a spark plug.
Figure 6:
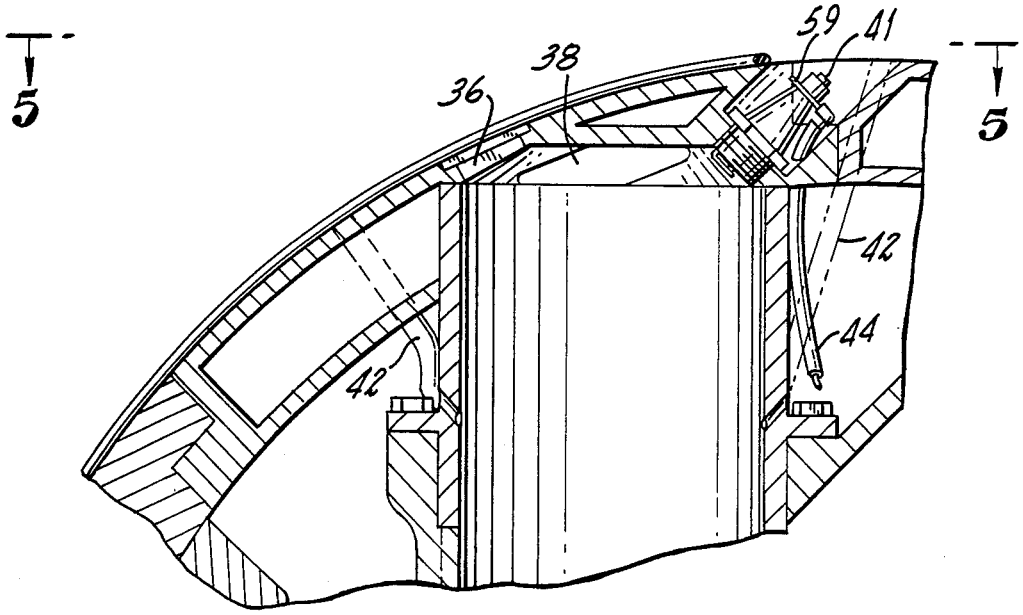
FIG. 6 is a sectional view taken along the line 6—6 of FIG. 5.

FIGS. 5 and 6 show a spark plug 41 associated with each cylinder head 19. FIG. 6 shows a spark plug wire 44. FIG. 4 shows an access plate 45 to obtain access to a spark plug in order to replace a spark plug 41 if such replacement is necessary. An outer assembly frame 47 for the cover assembly 51 is depicted in FIG. 4 as is an ignition plate bearing 48 mounted on an ignition plate mounting bracket 49. Note that the ignition plate mounting bracket 49 is mounted to the cover assembly 51 as clearly shown in FIG. 8. Also seen in FIG. 8 is an ignition advance gear 52 mounted to the end of an ignition advance lever 53. This adjusts the position of the ignition plate bearing 48 within the arcuate slot depicted in FIG. 8. Mounting bolts 54 (FIG. 4) are used to attach the mounting plate 47 to the cover assembly 51. FIG. 8 shows points 56 mounted to an ignition plate which cooperates with strike plate 58. Octagon Cam 14 rotates to control contact of points 56. FIG. 6 shows a spark plug wire terminal 59.

The engine includes bearing means comprising bearings 17 and 18 and their associated pressure plates 17A and 18A to prevent axial movement of the intermediate assembly relative to the cover assembly. The combination of grooved auger and hub attaching the auger to the movable intermediate portion provides a path for lubricant through the hub and the auger intermediate portion and the fixed shaft of the inner assembly to enable the lubricant to arrive at a position within the intermediate assembly that is rotating so as to be thrust outward by centrifugal force to the lubricant recovery system in the form of a peripheral ring 21.

Each of the piston cylinders is removably mounted within the intermediate portion. Each of the cylinder heads is physically attached to adjacent cylinder heads by means that form a peripheral belt that avoids the loss of intake and exhaust gases so as to enable the motor to operate more efficiently. Each cylinder has its own separate spark plug operatively associated therewith to provide more precise control and each spark plug has its point adjustable to be advanced or retarded as needed. Each cylinder head also comprises a ventilation opening constructed and arranged for moving alignment with alternative of the exhaust ports so as to enable the exhaust ports to be utilized for removal of air that has been used to cool the head.

The apparatus is also provided with conventional cooling fins 50 depicted in FIGS. 3 and 4. These enable cool air to flow against the outer walls of intermediate casing 4 and reduce the tendency of the engine to overheat.

It is understood that the intake and exhaust ports may be located in opposite positions from those described. This enables the engine to be used in the direction opposite from that specifically described without departing from the gist of this invention. The apparatus also includes some intake opening seals 64 shown around the intake opening 36 in FIG. 5 and added seals also along the cylinder head 19.

The cylinder heads 19 are mounted to the cylinders 3 using bolts 60 shown in FIG. 5. Additional bolts 61 interconnect cylinder heads 19 to one another.

From the foregoing, it is understood that the engine of the present invention comprises a fixed inner assembly, a fixed outer assembly and a rotatable intermediate assembly that moves in a circular path between the fixed inner assembly and the fixed outer assembly. The fixed inner assembly comprises the fixed shaft 1 and a pair of sun gears 5 fixed in axially spaced relation along the length of the shaft 1. The fixed outer assembly comprises two opposite outer assembly elements, fore element 2A and aft element 2B that cooperate with frame 51 to enclose the fixed inner assembly and the rotatable intermediate assembly. Each outer assembly element is provided with an intake port 33 and an exhaust port 34 in its peripheral portion. The intake port of one outer assembly element is diametrically opposite the intake port of the other outer assembly element and the exhaust port of each outer assembly element is diametrically opposite the exhaust port of the other outer assembly element. The intake port of each outer assembly element is circumferentially spaced from its associated exhaust port. A preferred spacing is approximately 90 degrees between the beginning of one intake port on one element of said fixed outer assembly and the exhaust port 34 of the other element of said fixed outer assembly. The construction of cylinder heads 19 with alternate locations of intake openings 36 and exhaust openings 38 facing outer assembly elements 2A and 2B makes it possible for the odd number heads (first, third, fifth and seventh) to have their intake openings 36 sweep past only the intake port 33 of one outer assembly element 2A or 2B without engaging its exhaust port 34 and their exhaust openings 38 sweep past only the exhaust port 34 of the other outer assembly element 2B or 2A without engaging its intake port 33 while the even number cylinder heads (second, fourth, sixth and eighth) counted consecutively in a circumferential direction will have their intake openings 36 sweep past only the intake port 33 of the other outer assembly element 2B or 2A without engaging its exhaust port 34 and their exhaust openings 38 sweep past only the exhaust port 34 of the one assembly element 2A or 2B without engaging its intake port 33 as the intermediate assembly 4 completes a cycle of rotation relative to the inner and outer fixed assemblies. This construction makes it impossible for the intake opening 36 and exhaust opening 38 of any one cylinder head 19 to make simultaneous engagement with an exhaust port and an intake port.

As the intermediate assembly rotates relative to the fixed inner and outer assembly, and if the ratio of gears in the sun gear to the planetary gears is two to one, each piston will move outward and inward twice within its piston cylinder during each complete cycle of revolution of the intermediate assembly relative to the fixed outer and inner assembly. Thus, there will be a total of eight firings during each revolution of the intermediate assembly. The rotatable intermediate assembly comprises a plurality of pairs of planetary gears each provided with a crankshaft eccentrically mounted with respect to said pairs of planetary gears so as to cause diametrically opposite pistons operatively connected to diametrically opposite of said crankshafts to be spaced equal radial distances from the fixed inner assembly at all times during a rotational cycle of the intermediate assembly. This balances inward and outward piston movement relative to the center of gravity of the engine as the intermediate assembly performs a cycle of rotation.

The valve-free engine has its piston cylinders extending oblique to a radius of the fixed inner assembly by an equal angle of obliquity (42 degrees in a preferred eight cylinder engine). Each of the piston cylinders is oriented to have its axis aligned with the plane tangential to the sun gears when the piston is fired to move inwardly in a direction having a component of motion tangent to the circumference of the sun gears 5 in a direction of rotation of the movable intermediate assembly. This results in more efficient operation of the engine of this invention.

Figure 7:
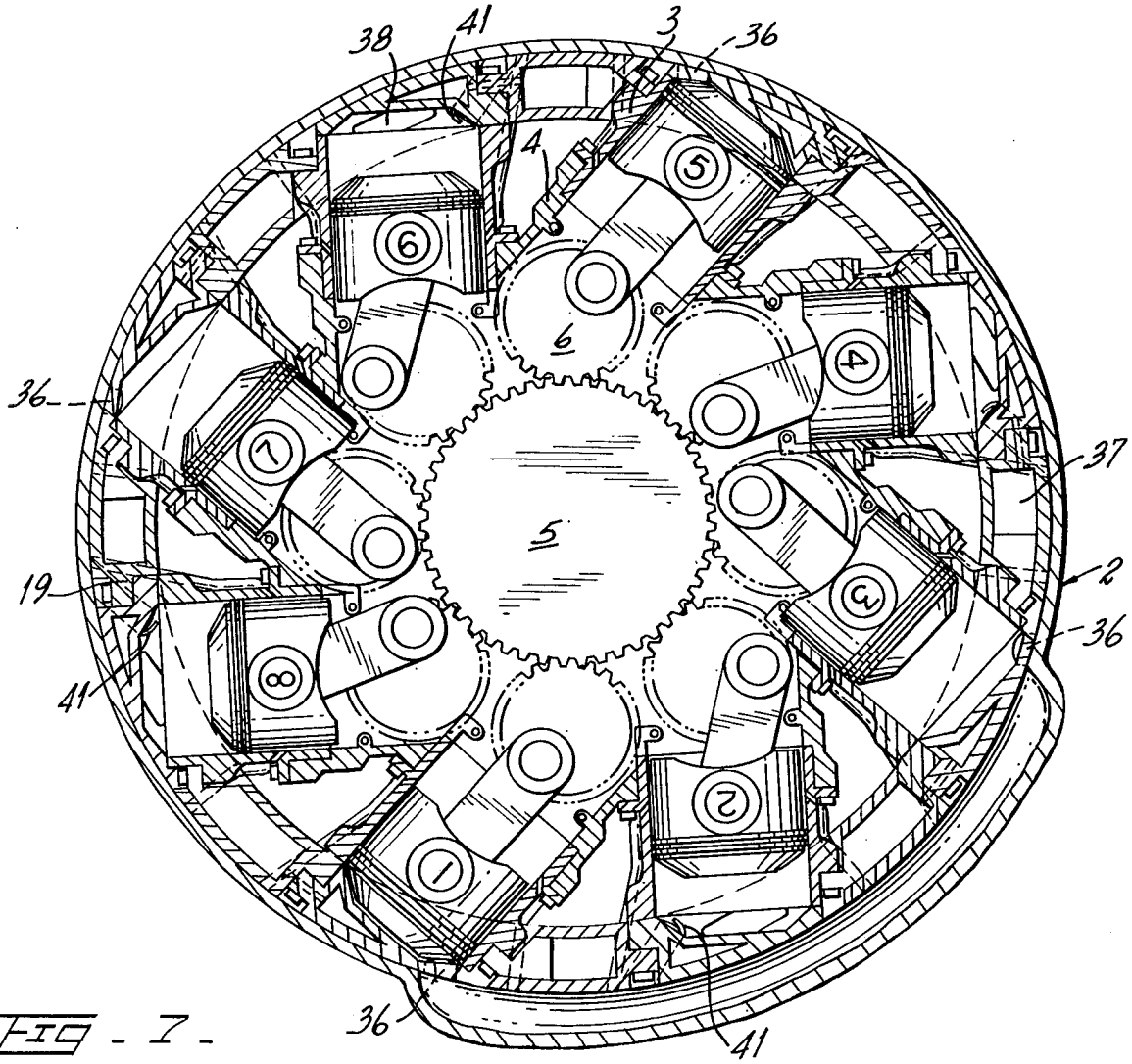
FIG. 7 is a sectional view of a portion of the intermediate portion showing how it surrounds the sun gear of the fixed inner assembly of the present invention and also incorporates the fixed outer assembly surrounding the rotatable intermediate assembly.

A typical cycle takes advantage of the fact that the eight cylinder heads 19 are circumferentially spaced 45 degrees from one another. The heads rotate counterclockwise as seen in FIGS. 3 and 7. The intake openings 36 of the odd number cylinder heads are offset to one side of the center of assembly 2 to sweep past only intake port 33 of outer assembly element 2B and their exhaust openings 38 are offset to the other side edge of said center to sweep past only exhaust port 34 of said outer assembly element 2A, and the even number cylindrical heads have their intake openings 36 offset to the other side to sweep past intake port 33 only of outer assembly element 2A and their exhaust openings 38 offset to sweep past only exhaust port 34 of outer assembly element 2B. When the first odd number cylinder head has its intake opening 36 begin to sweep past intake port 33 of element 2B by approaching the south, an even number cylinder head is 45 degrees from approaching the north where its intake opening 36 begins to sweep intake port 33 of outer assembly element intake opening 36 of said first odd number cylinder head sweeps past intake port 33 of element 2B, it completes the intake step of the 4 step combustion cycle while its associated crank shaft 7 moves from its apogee (position 1 of FIG. 7) to its perigee (position 3 of FIG. 7) to pull in its piston and cause the cylinder head chamber outside the piston to expand as the first odd number cylinder head rotates toward the east. As the latter head rotates from east to north, it passes exhaust port 34 of element 2B. Since its intake opening 36 is offset from the exhaust port 34 of of element 2B, no intake or exhaust occurs as movement of crank shaft 7 from its perigee (position 3) to its apogee (position 5) compresses the fuel and prepares the first odd number head to reach a north position where Cam 14 activates strike plate 15 to cause points 56 to contact and cause an explosion, causing its piston to move in the direction of rotation and its exhaust opening 38 to sweep past exhaust port 34 of element 2B as the piston is actuated by its associated crank shaft 7 to force composition products out via exhaust opening 38 and exhaust port 34 of element 2B to complete a cycle for the odd number head.

After counterclockwise rotation of 90 degrees from the time the first odd number head has its intake opening 36 begin to sweep intake port 33 of element 2A at the southern portion, a second odd number head beings the same cycle.

After 45 degrees of rotation from the time that the first odd number head starts to sweep intake port 33 of assembly element 2B, an even number cylinder head has its intake opening 36 sweep intake port 33 of element 2A near the north. Its crankshaft 7 moves its piston inward from position 5 of FIG. 7 to position 7 of FIG. 7 as the even number cylinder head moves from north to west, thus expanding its combustion chamber outward of its associated piston. Combustion takes place in the first named even numbered cylinder head 19 immediately after the first named even number cylinder head passes the exhaust port 33 of element 2A and crank 7 moves from its position 7 to position 1 to force its piston outward and accomplish the compression stroke. This rotation of the first even number cylinder head 19 causes it to pass exhaust port 34 of element 2A and reach the south position where firing takes place. Crankshaft 7 associated with the piston within first named even number cylinder head 19 causes inward movement of said piston from position 1 to position 3 to augment the movement caused by the combustion immediately beyond exhaust port 34 of element 2A. Continued movement of the crank 7 from position 3 to position 5 causes outward movement of said piston as said first cylinder head 19 passes into alignment with said exhaust port 34 o exhaust its spent gas as it sweeps past exhaust port 34 of element 2B and become ready for its next intake. The third, fifth and seventh pistons are cycled after 90, 180 and 270 degrees of rotation of intermediate portion 4 from the first odd number piston. The even numbered cylinder heads fire after 45 degrees of rotation after the firing of the immediately fired odd number cylinder head because of the 45 degree offset between the odd numbered and even numbered cylinder heads. The succeeding even number cylinder heads fire after 135 degrees, 225 degrees and 315 degrees of rotations of the rotatable intermediate assembly 4 following the firing of the first odd number head.

The balance of the weights of the eight pistons at any phase of a cycle of revolution can be observed by studying FIG. 7. Pistons in the first and fifth diametrically opposite cylinder heads 19 are extended to their apogees while those in the third and seventh pair of diametrically opposite cylinder heads are at their perigees relative to the center of sun gears 5. The other two pairs of diametrically opposite pistons are mid-way their fully retracted and fully extended positions. Since the distances of the pistons in the first and fifth cylinder heads change equally relative to inner assembly shaft 1 and the distances of the pistons in each other pair of diametrically opposite cylinder heads (second with sixth, and third with seventh, and fourth with eighth) also change equally relative to inner assembly shaft 1, the center of gravity of the rotatable intermediate assembly 4 remains at the inner assembly shaft 1 throughout a rotational cycle of the rotatable intermediate assembly 4.

Conforming to the requirements of the patent statutes, a description and illustration has been made of what is presently considered to be a preferred embodiment of the present invention. It is understood, however, that the invention may be modified without departing from the spirit of the present invention recited in the claimed subject matter that follows.

What is claimed is:

1. A valve-free, eight cylinder engine comprising a fixed inner assembly, a fixed outer assembly and a rotatable intermediate assembly movable in a circular path between said fixed inner assembly and said fixed outer assembly, said fixed inner assembly comprising a fixed shaft and a pair of sun gears fixed to said shaft in axially spaced relation therealong, said fixed outer assembly comprising two opposite, fore and aft, outer assembly elements enclosing said fixed inner assembly and said movable intermediate assembly, each said outer assembly element being provided with an intake port and an exhaust port in its peripheral portion, said intake port of one outer assembly element being diametrically opposite said intake port of said other outer assembly element and said exhaust port of said one outer assembly element being diametrically opposite said exhaust port of said other outer assembly element, said intake port of each outer assembly element being circumferentially spaced from said exhaust port thereof, said rotatable intermediate assembly having pairs of planetary gears engaging said pair of sun gears to rotate around said sun gears, a crankshaft interconnecting each pair of planetary gears for rotation therewith, a piston operatively connected to each of said crankshafts for in and out movement responsive to rotation of its associated crankshaft, a piston cylinder within which each piston is mounted for movement therewithin as said planetary gears rotate about said sun gear and said intermediate assembly moves in a circular path about said fixed inner assembly, each said piston cylinder having a cylinder head comprising an intake opening positioned alternately for sweeping alignment with said intake port of one and misalignment with said intake port of the other outer assembly element and an exhaust opening positioned for sweeping alignment with said exhaust port of one and misalignment with said exhaust port of the other outer assembly element as said intermediate assembly rotates, said intake opening and said exhaust opening of alternate of said piston cylinder heads being alternately positioned for alignment with said intake ports and said exhaust ports of opposite of said outer assembly elements, diametrically opposite of said crankshafts being oriented so that said pistons operatively connected thereto are spaced equal radial distances from said fixed inner assembly at all times during a rotational cycle of said intermediate assembly, the orientation of said crankshafts differing by an equal amount between adjacent of said crankshafts and said piston cylinders being equally spaced circumferentially of said intermediate assembly.

2. A valve-free engine as set forth in claim 1, wherein said intake port of one of said outer assembly elements is circumferentially adjacent said exhaust port of said other outer assembly element and said intake port of said other outer assembly element is circumferentially adjacent said exhaust port of said one outer assembly element.

3. A valve-free engine as set forth in claim 1, wherein each of said piston cylinder heads is mounted obliquely to a radius from said fixed inner assembly by an equal angle of obliquity.

4. A valve free engine as set forth in claim 3, wherein each of said piston cylinders is constructed and arranged to be oriented to have its axis aligned with a plane tangential to said sun gears when said piston is fired to move inwardly in a direction having a component of motion in the direction of rotation of said rotatable intermediate assembly.

5. A valve-free engine as set forth in claim 1, further including a cover assembly fixed to both said fixed inner assembly and said fixed outer assembly and auxiliary bearings between said cover assembly and said movable intermediate assembly to resist wobble of said movable intermediate assembly between said inner and outer assemblies.

6. A valve-free engine as set forth in claim 5, further including bearing means within said cover assembly to prevent axial movement of said intermediate assembly relative to said cover assembly.

7. A valve-free engine as set forth in claim 1, further including a grooved auger, a hub attaching said auger to said movable intermediate portion, a path for lubricant through said hub and said auger intermediate said intermediate portion and said shaft.

8. A valve-free engine as set forth in claim 1, wherein each of said piston cylinders is removably mounted to a cylinder head within said intermediate portion.

9. A valve-free engine as set forth in claim 1, wherein said intermediate assembly comprises a fore element and an aft element bolted together and a cylinder head is fixed to the outer end of each cylinder, and said cylinder heads are connected to one another to form a circumferential belt surrounding said intermediate portion.

10. A valve-free engine as set forth in claim 9, further including a spark plug operatively associated with each said piston cylinder head.

11. A valve-free engine as set forth in claim 9, wherein each alternate of said cylinder heads comprises an exhaust opening constructed and arranged for sweeping alignment with alternate of said exhaust ports and complete misalignment with the other exhaust port as said rotatable intermediate assembly rotates relative to said fixed assemblies.

* * * * *